US008967272B2

(12) United States Patent
Mock et al.

(10) Patent No.: US 8,967,272 B2
(45) Date of Patent: Mar. 3, 2015

(54) ANNULAR PRESSURE RELIEF SYSTEM

(71) Applicant: Hunting Energy Services, Inc., Houston, TX (US)

(72) Inventors: Michael E. Mock, Kingwood, TX (US); Robert S. Sivley, IV, Kingwood, TX (US); Mark C. Moyer, The Woodlands, TX (US)

(73) Assignee: Hunting Energy Services, Inc., Houston, TX (US)

( * ) Notice: Subject to any disclaimer, the term of this patent is extended or adjusted under 35 U.S.C. 154(b) by 0 days.

(21) Appl. No.: 14/184,832

(22) Filed: Feb. 20, 2014

(65) Prior Publication Data

US 2014/0231092 A1 Aug. 21, 2014

Related U.S. Application Data

(60) Provisional application No. 61/767,560, filed on Feb. 21, 2013.

(51) Int. Cl.

| | |
|---|---|
| ***E21B 34/04*** | (2006.01) |
| ***E21B 34/08*** | (2006.01) |
| ***E21B 41/00*** | (2006.01) |
| ***E21B 17/08*** | (2006.01) |

(52) U.S. Cl.

CPC ..... *E21B 41/0021* (2013.01); *E21B 34/04* (2013.01); *E21B 17/08* (2013.01)

USPC ..... 166/363; 166/345; 166/368; 166/373

(58) Field of Classification Search

CPC ..... E21B 34/04; E21B 34/08

USPC ..... 166/363, 344, 345, 368, 373, 386, 325; 251/336, 73

See application file for complete search history.

(56) References Cited

U.S. PATENT DOCUMENTS

| | | | | |
|---|---|---|---|---|
| 2,178,845 | A | | 11/1939 | Baker |
| 2,761,468 | A | * | 9/1956 | Thatcher ..... 137/539 |
| 3,366,182 | A | | 1/1968 | Solum |
| 3,417,822 | A | | 12/1968 | Howell |
| 3,572,372 | A | * | 3/1971 | Moore ..... 137/477 |
| 3,827,486 | A | | 8/1974 | Hall |
| 3,882,935 | A | | 5/1975 | Calhoun |
| 4,286,662 | A | | 9/1981 | Page, Jr. |
| 4,446,886 | A | * | 5/1984 | Taylor et al. ..... 137/516.29 |
| 4,582,149 | A | | 4/1986 | Slaughter, Jr. |
| 4,590,957 | A | | 5/1986 | McFarlane |
| 4,750,510 | A | | 6/1988 | Short, III |
| 5,020,600 | A | | 6/1991 | Coronado |
| 5,109,925 | A | | 5/1992 | Stepp et al. |
| 5,161,738 | A | | 11/1992 | Wass |

(Continued)

*Primary Examiner* — Matthew Buck

(74) *Attorney, Agent, or Firm* — Charles D. Gunter, Jr.

(57) ABSTRACT

A modified casing coupling houses a pressure relief valve body having a through bore with opposing end openings. The through bore communicates with the interior of the modified casing coupling at one end opening thereof and with an area surrounding the modified casing coupling at an opposite end opening. The through bore includes a ball seat adjacent one end opening thereof which receives a sealing ball. The ball is urged in the direction of the ball seat by a tensioning element. The ball is exposed to annular pressure trapped between successive lengths of well casing located in the well borehole. The amount of tension exerted on the ball by the tensioning element is selected to allow the ball to move off the ball seat to release trapped annular pressure between the selected casing strings once a certain annulus pressure is reached.

7 Claims, 5 Drawing Sheets

(56) References Cited

U.S. PATENT DOCUMENTS

| | | | | |
|---|---|---|---|---|
| 5,341,883 | A | 8/1994 | Ringgenberg | |
| 5,411,097 | A | 5/1995 | Manke et al. | |
| 6,095,247 | A | 8/2000 | Streich et al. | |
| 6,176,311 | B1 | 1/2001 | Ryan | |
| 6,293,346 | B1 | 9/2001 | Patel | |
| 6,450,263 | B1 | 9/2002 | Schwendemann | |
| 6,457,528 | B1 * | 10/2002 | Staudt | 166/363 |
| 6,675,898 | B2 * | 1/2004 | Staudt | 166/363 |
| 7,048,059 | B2 * | 5/2006 | Adams et al. | 166/348 |
| 8,066,074 | B2 * | 11/2011 | Maskos et al. | 166/324 |
| 8,353,351 | B2 * | 1/2013 | Carpenter et al. | 166/338 |
| 8,607,818 | B2 * | 12/2013 | Monroe et al. | 137/478 |
| 2001/0022225 | A1 | 9/2001 | Burris et al. | |
| 2004/0238178 | A1 * | 12/2004 | Laureano et al. | 166/368 |
| 2005/0189107 | A1 * | 9/2005 | McVay et al. | 166/242.1 |
| 2011/0114333 | A1 * | 5/2011 | Fenton | 166/373 |
| 2012/0273226 | A1 * | 11/2012 | Hebert et al. | 166/373 |

* cited by examiner

ANNULAR PRESSURE RELIEF SYSTEM

CROSS REFERENCE TO RELATED APPLICATIONS

The present application claims priority from a previously filed provisional application Ser. No. 61/767,560, filed Feb. 21, 2013, entitled "Annular Pressure Relief System", by the same inventors.

BACKGROUND OF THE INVENTION

1. Field of the Invention

The present invention relates generally to a method for the prevention of damage to oil and gas wells, and, more specifically, to the prevention of damage to the well casing from critical annular pressure buildup.

2. Description of the Prior Art

The physics of annular pressure buildup (APB) and associated loads exerted on well casing and tubing strings have been experienced since the first multi-string completions. APB has drawn the focus of drilling and completion engineers in recent years. In modern well completions, all of the factors contributing to APB have been pushed to the extreme, especially in deep water wells.

APB can be best understood with reference to a subsea wellhead installation. In oil and gas wells it is not uncommon that a section of formation must be isolated from the rest of the well. This is typically achieved by bringing the top of the cement column from the subsequent string up inside the annulus above the previous casing shoe. While this isolates the formation, bringing the cement up inside the casing shoe effectively blocks the safety valve provided by nature's fracture gradient. Instead of leaking off at the shoe, any pressure buildup will be exerted on the casing, unless it can be bled off at the surface. Most land wells and many offshore platform wells are equipped with wellheads that provide access to every casing annulus and an observed pressure increase can be quickly bled off. Unfortunately, most subsea wellhead installations do not have access to each casing annulus and often a sealed annulus is created. Because the annulus is sealed, the internal pressure can increase significantly in reaction to an increase in wellbore temperature.

Most casing strings and displaced fluids are installed at near-static temperatures. On the sea floor the temperature is around 34° F. The production fluids are drawn from "hot" formations that dissipate and heat the displaced fluids as the production fluid is drawn towards the surface. When the displaced fluid is heated, it expands and a substantial pressure increase may result. This condition is commonly present in all producing wells, but is most evident in deep water wells. Deep water wells are likely to be vulnerable to APB because of the cold temperature of the displaced fluid, in contrast to elevated temperature of the production fluid during production. Also, subsea wellheads do not provide access to all the annulus and any pressure increase in a sealed annulus cannot be bled off. Sometimes the pressure can become so great as to collapse the inner string or even rupture the outer string, thereby destroying the well.

One previous solution to the problem of APB was to take a joint in the outer string casing and mill a section off so as to create a relatively thin wall. However, it was very difficult to determine the pressure at which the milled wall would fail or burst. This could create a situation in which an overly weakened wall would burst when the well was being pressure tested. In other cases, the milled wall could be too strong, causing the inner string to collapse before the outer string bursts.

In U.S. Pat. No. 6,675,898, assigned to the assignee of the present invention, an alternative design was shown which comprised a casing coupling modified to include at least one receptacle for housing a modular "burst disk" assembly. The burst disk assembly was designed to fail at a predetermined pressure and was compensated for temperature. The disk was designed to intentionally fail when the trapped annular pressure threatened the integrity of either the inner or outer casing. The design also allowed for the burst disk assembly to be installed on location or before pipe shipment.

Despite the advantages offered by the improved burst disk design, a need continues to exist for further improvements in automatic pressure relief systems of the type under consideration.

SUMMARY OF THE INVENTION

It is therefore an object of the present invention to provide a modified casing coupling with a pressure relief feature that will hold a sufficient internal pressure to allow for pressure testing of the casing but which will reliably release when the pressure reaches a predetermined level.

It is another object of the present invention to provide a modified casing coupling that will release at a pressure less than the collapse pressure of the inner string and less than the burst pressure of the outer string.

It is yet another object of the present invention to provide a modified casing coupling that is relatively inexpensive to manufacture, easy to install, and is reliable in a fixed, relatively narrow range of pressures.

The above objects are achieved by creating a modified casing coupling which can be used in a casing string of the type used on an offshore well having a subsea well head connected by a subsea conduit to a floating work station, where the subsea well head is connected to a plurality of casing strings located in a borehole below the subsea well head and defining at least one casing annulus therebetween.

The modified casing coupling houses a pressure relief valve for relieving annular pressure between at least selected casing strings under predetermined pressure buildup conditions. The modified casing coupling has sidewalls which define an interior and an exterior of the coupling. The receptacle housing also includes a through bore with opposing end openings, the through bore communicating with the interior of the modified casing coupling at one end opening thereof and with an area surrounding the modified casing coupling at an opposite end opening thereof.

The through bore includes a ball seat adjacent one end opening thereof which receives a sealing ball, and wherein the ball is urged in the direction of the ball seat by a tensioning element located within the through bore which exerts a given amount of tension on the ball. The ball is exposed to annular pressure trapped between successive lengths of well casing located in the well borehole. The through bore can be arranged to communicate with the interior of the modified casing coupling by a port provided in a sidewall of the modified casing coupling. The amount of tension exerted on the ball by the tensioning element is selected to allow the ball to move off the ball seat and to thereby release trapped annular pressure between the selected casing strings once a predetermined annulus pressure is reached.

The tensioning element used in the pressure relief valve can conveniently be selected from the group consisting of coil springs, washers, Belleville spring washers and combinations thereof. The ball seat can be provided at either end of the through bore, whereby the pressure relief valve can be configured to operate in either of two directions, depending upon which ball seat receives a sealing ball. In other words, the modified casing receptacle can be configured to accept both internal and external pressure type valve bodies.

A method is also shown for the prevention of damage in offshore oil and gas wells due to trapped annular pressure between successive lengths of well casing. A modified casing coupling, as previously described, is installed within at least a selected casing string and is provided with the previously described pressure relief valve. The through bore of the pressure relief valve communicates with the interior of the modified casing coupling at one end opening thereof and with an area surrounding the modified casing coupling at an opposite end opening thereof. The through bore is provided with the ball seat and sealing ball as previously described. The ball is exposed to annular pressure trapped between successive lengths of well casing located in the well borehole. By properly selecting the amount of tension which the tensioning element exerts on the sealing ball, the ball can be allowed to move off the ball seat to thereby release trapped annular pressure between the selected casing strings once a predetermined annulus pressure is reached. The pressure at which the pressure relief valve opens is specified by the user, and is compensated for temperature. The valve opens when the trapped annular pressure threatens the integrity of either the inner or outer casing.

Additional objects, features and advantages will be apparent in the written description which follows.

DETAILED DESCRIPTION OF THE INVENTION

Figure 5:
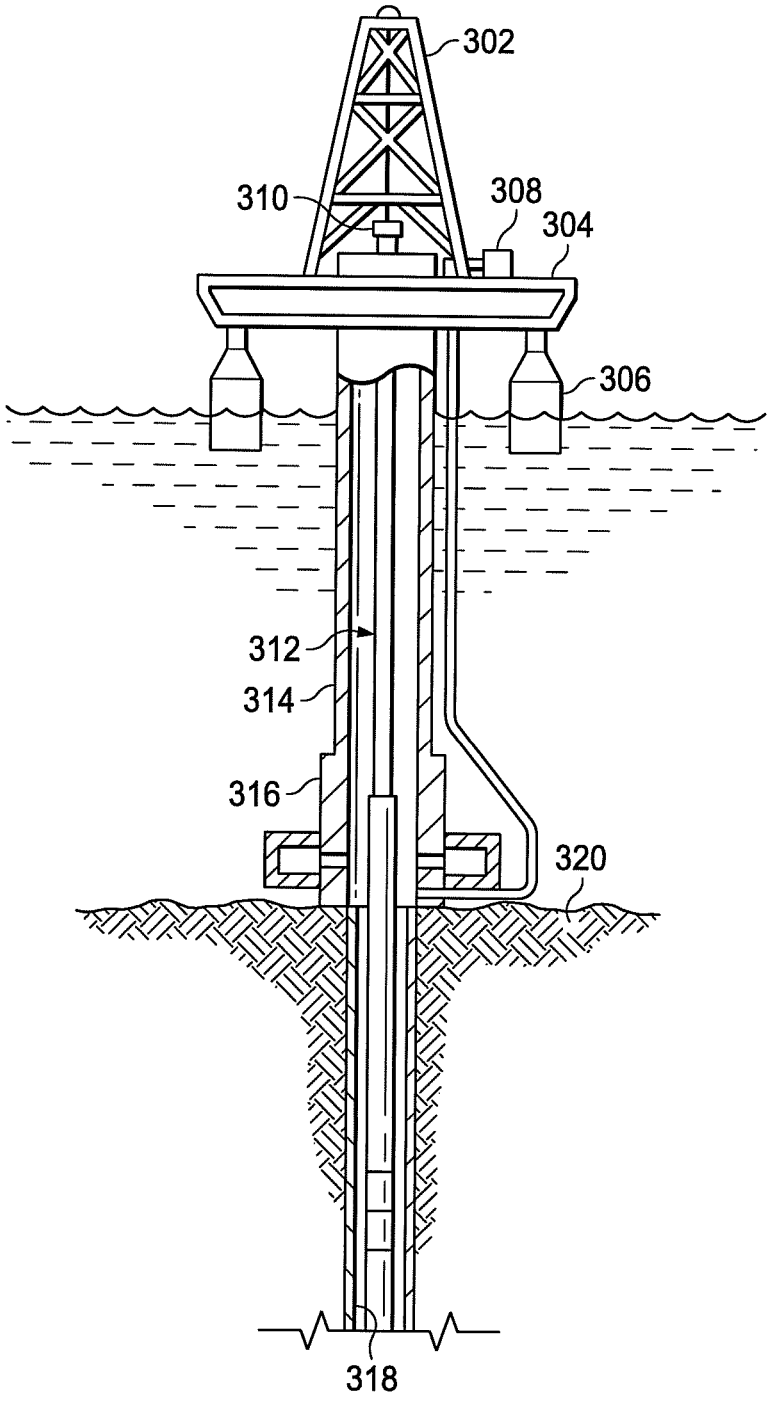
FIG. 5 is a simplified view of an off-shore well drilling rig.

Turning first to FIG. 5, there is shown a simplified view of a typical offshore well drilling rig. The derrick 302 stands on top of the deck 304. The deck 304 is supported by a floating work station 306. Typically, on the deck 304 is a pump 308 and a hoisting apparatus 310 located underneath the derrick 302. Casing 312 is suspended from the deck 304 and passes through the subsea conduit 314, the subsea well head installation 316 and into the borehole 318. The subsea well head installation 316 rests on the sea floor 320.

As will be familiar to those skilled in the relevant arts, a rotary drill is typically used to bore through subterranean formations of the earth to form the borehole 318. As the rotary drill bores through the earth, a drilling fluid, known in the industry as a "mud," is circulated through the borehole 318. The mud is usually pumped from the surface through the interior of the drill pipe. By continuously pumping the drilling fluid through the drill pipe, the drilling fluid can be circulated out the bottom of the drill pipe and back up to the well surface through the annular space between the wall of the borehole 318 and the drill pipe. The mud is used to help lubricate and cool the drill bit and facilitates the removal of cuttings as the borehole 318 is drilled. Also, the hydrostatic pressure created by the column of mud in the hole prevents blowouts which would otherwise occur due to the high pressures encountered within the wellbore. To prevent a blowout caused by the high pressure, heavy weight is put into the mud so the mud has a hydrostatic pressure greater than any pressure anticipated in the drilling.

Different types of mud must be used at different depths because the deeper the borehole 318, the higher the pressure. For example, the pressure at 2,500 ft. is much higher than the pressure at 1,000 ft. The mud used at 1,000 ft. would not be heavy enough to use at a depth of 2,500 ft. and a blowout would occur. In subsea wells the pressure at deep depths is tremendous. Consequently, the weight of the mud at the extreme depths must be particularly heavy to counteract the high pressure in the borehole 318. The problem with using a particularly heavy mud is that if the hydrostatic pressure of the mud is too heavy, then the mud will start encroaching or leaking into the formation, creating a loss of circulation of the mud. Because of this, the same weight of mud cannot be used at 1,000 feet that is to be used at 2,500 feet. For this reason, it is generally not possible to put a single casing string all the way down to the desired final depth of the borehole 318. The weight of the mud necessary to reach the great depth would be too great.

To enable the use of different types of mud, different strings of casing are employed to eliminate the wide pressure gradient found in the borehole 318. To start, the borehole 318 is drilled to a depth where a heavier mud is required, for example around 1000 ft. When this happens, a casing string is inserted into the borehole 318. A cement slurry is pumped into the casing and a plug of fluid, such as drilling mud or water, is pumped behind the cement slurry in order to force the cement up into the annulus between the exterior of the casing and the borehole 318. Typically, hydraulic cements, particularly Portland cements, are used to cement the well casing within the borehole 318. The cement slurry is allowed to set and harden to hold the casing in place. The cement also provides zonal isolation of the subsurface formations and helps to prevent sloughing or erosion of the borehole 318.

After the first casing is set, the drilling continues until the borehole 318 is again drilled to a depth where a heavier mud is required and the required heavier mud would start encroaching and leaking into the formation. Again, a casing string is inserted into the borehole 318, for example around 2,500 feet, and a cement slurry is allowed to set and harden to hold the casing in place as well as provide zonal isolation of the subsurface formations, and help prevent sloughing or erosion of the borehole 318.

Another reason multiple casing strings may be used in a bore hole is to isolate a section of formation from the rest of the well. To accomplish this, the borehole 318 is drilled through a formation or section of the formation that needs to be isolated and a casing string is set by bringing the top of the cement column from the subsequent string up inside the annulus above the previous casing shoe to isolate that formation. This may have to be done a number of times, depending on how many formations need to be isolated. By bringing the cement up inside the annulus above the previous casing shoe the fracture gradient of the shoe is blocked. Because of the blocked casing shoe, pressure is prevented from leaking off at the shoe and any pressure buildup will be exerted on the casing. Sometimes this excessive pressure buildup can be bled off at the surface or a blowout preventor (BOP) can be attached to the annulus.

However, a subsea wellhead typically has an outer housing secured to the sea floor and an inner wellhead housing received within the outer wellhead housing. During the completion of an offshore well, the casing and tubing hangers are lowered into supported positions within the wellhead housing through a BOP stack installed above the housing. Following completion of the well, the BOP stack is replaced by a Christmas tree having suitable valves for controlling the production of well fluids. The casing hanger is sealed off with respect to the housing bore and the tubing hanger is sealed off with respect to the casing hanger or the housing bore, so as to effectively form a fluid bather in the annulus between the casing and tubing strings and the bore of the housing above the tubing hanger. After the casing hanger is positioned and sealed off, a casing annulus seal is installed for pressure control. If the seal is on a surface well head, often the seal can have a port that communicates with the casing annulus. However, in a subsea wellhead housing, there is a large diameter low pressure housing and a smaller diameter high pressure housing. Because of the high pressure, the high pressure housing must be free of any ports for safety. Once the high pressure housing is sealed off, there is no way to have a hole below the casing hanger for blow out preventor purposes. There are only solid annular members with no means to relieve excessive pressure buildup.

Figure 3:
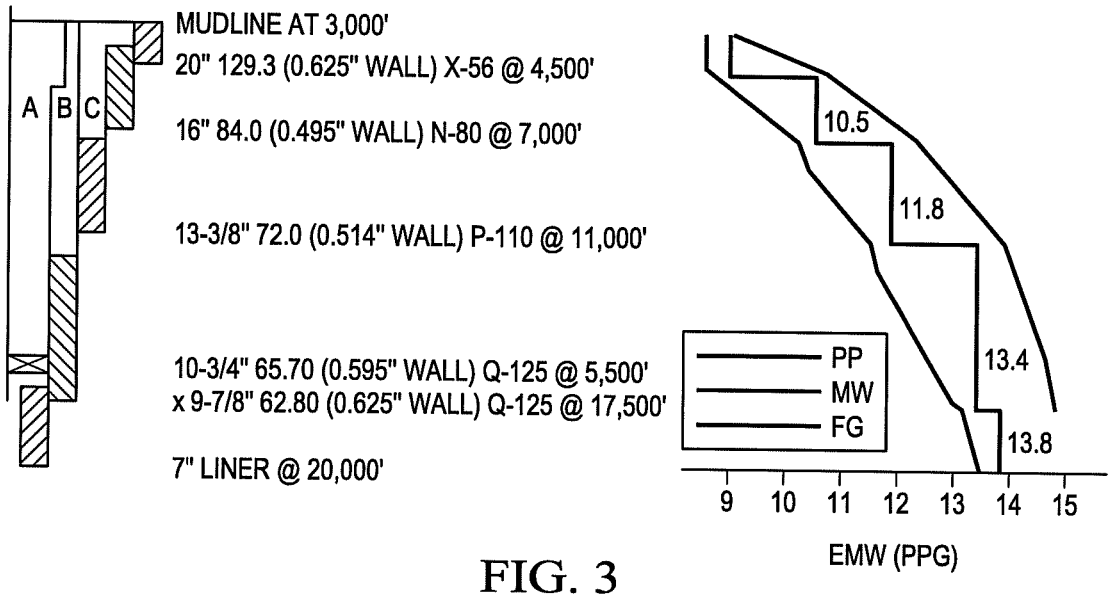
FIG. 3 is a simplified view of an example well configuration of the type which might utilize the automatic pressure relief system of the invention.

The present invention is directed toward improvements in APRS systems of the type used to avoid the above described problems caused by APB. APB mitigation using APRS is a well-specific design task. The example well configuration is shown in FIG. 3 is used to illustrate the various design parameters for a particular well under consideration. Casing ratings are provided in Table 1. The well is a subsea completion and the wellhead configuration allows for access to the tubing× casing ("A") annulus only (see FIG. 3). Although the 13⅜" and 9⅞" cement tops (TOC) are shown below the previous casing shoes, it is possible that those shoes may get sealed off due to cement channeling above the planned TOC or due to barite settling and forming a plug.

TABLE 1

Casing Ratings for Example Well

| | API Ratings | | ISO Proposed | |
|---|---|---|---|---|
| Casing Ratings (psi) | MIYP | Collapse | Rupture | Collapse |
| 20" 129.3 X-56 | 3,060 | 1,450 | 3,750 | 1,530 |
| 16" 84.0 N-80 | 4,330 | 1,480 | 5,290 | 1,660 |
| 13-⅜" 72.00 P-110 | 7,400 | 2,880 | 8,390 | 3,270 |
| 10-¾" 65.70 Q-125 | 12,110 | 7,920 | 13,350 | 8,910 |
| 9-⅞" 62.80 Q-125 | 13,840 | 11,140 | 15,370 | 11,920 |

Figure 4:
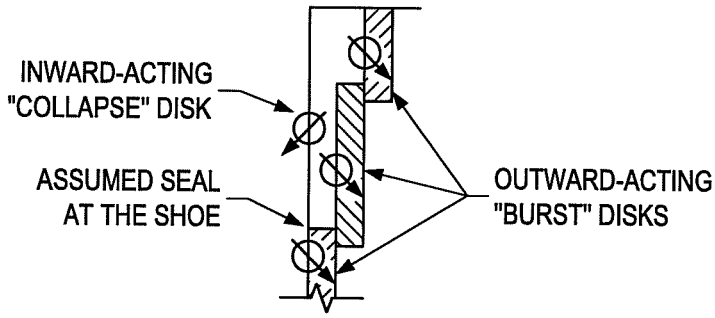
FIG. 4 is a view of several possible automatic pressure relief configurations.

If APB in the 13⅜"×20" or C annulus is determined to be a concern, primarily due to a high collapse load on the 13⅜" casing, then the pressure can be relieved by using an outward-venting APRS in either the 20" or 16" strings or an inward-acting APRS in the 13⅜" casing (see FIG. 4).

An outward-acting APRS protects the 13⅜" casing by venting excess pressure in the "burst" direction. Thus, the APRS device should be specified to release pressure before the inner string collapse resistance is exceeded. Ideally, the pressure rating of the APRS device is specified to exceed the outer casing minimum internal yield pressure (MIYP) so it does not interfere with the normal casing design process, but is also lower than the pipe's mechanical rupture rating.

A second way of protecting the 13⅜" casing from mechanical collapse is to include an inward-acting APRS within the 13⅜" string. A collapsed 13⅜" casing could place a non-uniform shock load on the production casing, possibly propagating failure to the inner strings. Rather than risk this catastrophic failure scenario, an inward-acting APRS device could provide a means of equalizing differential collapse pressure across the 13⅜" prior to reaching the mechanical collapse threshold.

Figure 1:
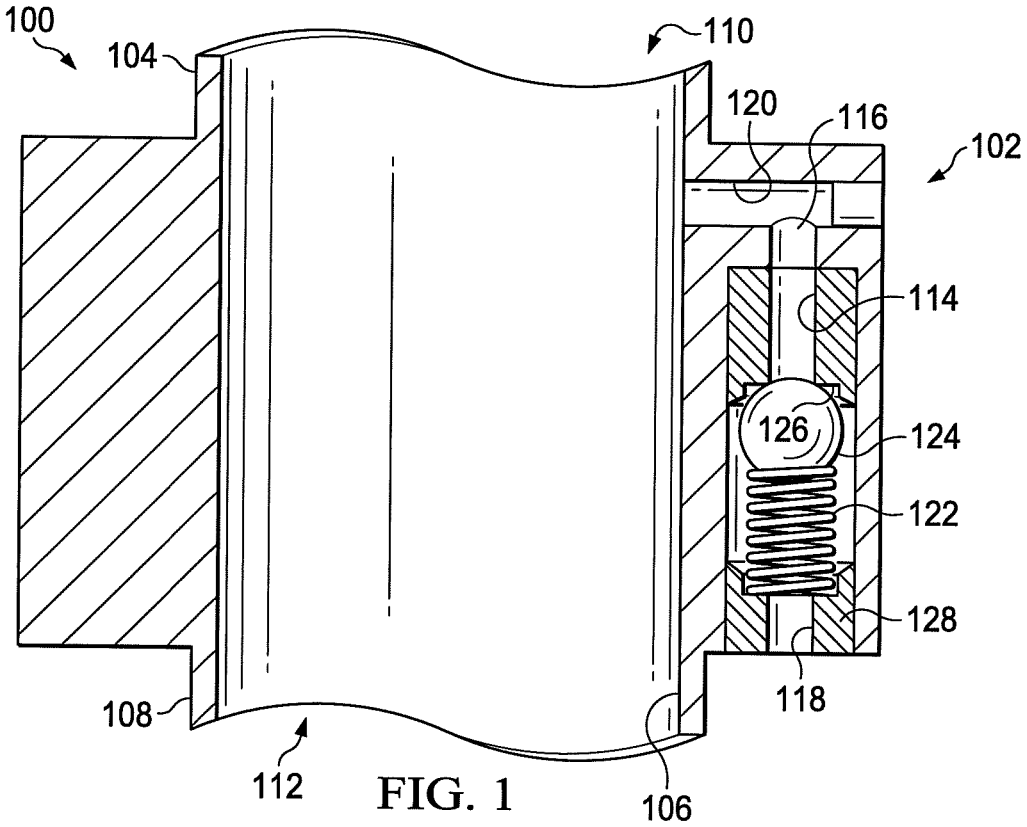
FIG. 1 is a side, cross sectional, partly schematic view of an automatic pressure relief sub of the invention configured to release internal pressure.
Figure 2:
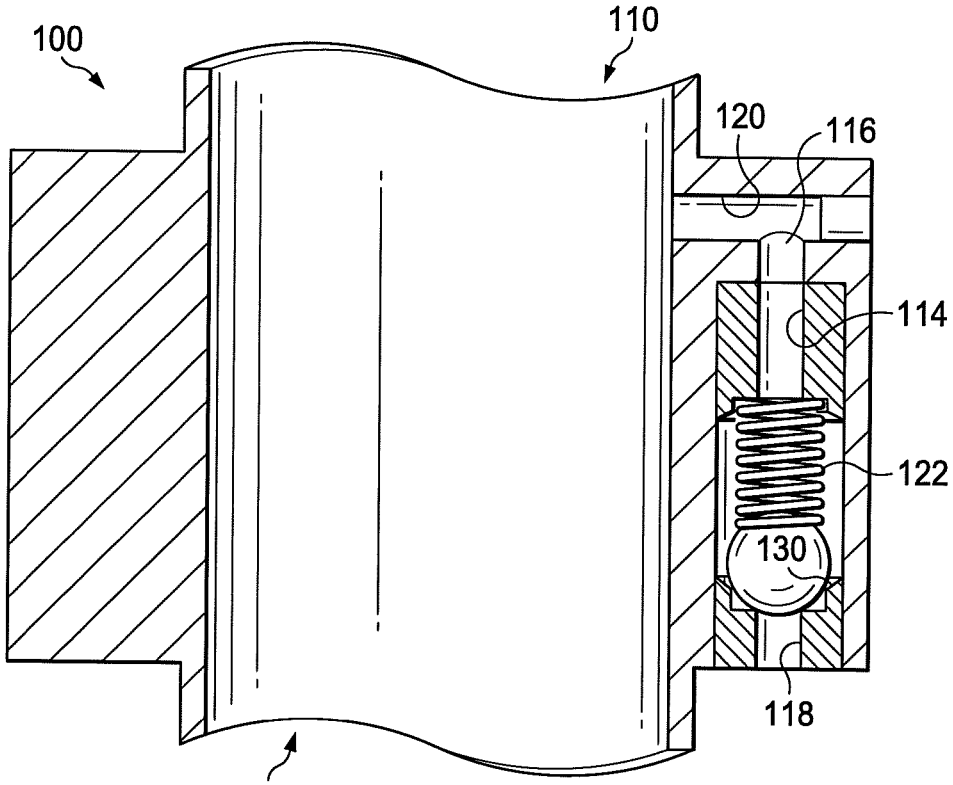
FIG. 2 is a view similar to FIG. 1, but showing the sub configured for release of external pressure.

Turning now to FIGS. 1 and 2, there is shown a simplified, partly schematic explanation of the improved APRS system of the invention. The system includes a modified casing coupling, designated generally as 100 in FIG. 1. The casing coupling would be designed to be used within a casing string located in a borehole below the subsea well head. As explained with respect to FIG. 3, the subsea well head would be connected by a subsea conduit to a floating work station. The subsea well head would typically be being connected to a plurality of casing strings located in the borehole below the subsea well head and defining at least one casing annulus therebetween.

As shown in FIG. 1, the modified casing coupling 100 has at least one receptacle housing 102 for housing a pressure relief feature, such as a pressure relief valve. The modified casing coupling 100 has sidewalls 104 which define an interior 106 and an exterior 108 and opposing end openings 110, 112 of the coupling. The opposing ends of the modified coupling would be appropriately threaded to allow the modified casing coupling to be integrated into the well casing string.

As can be seen in FIG. 1, the receptacle housing 102 includes a through bore 114 with opposing end openings 116, 118. The through bore 114 of the receptacle housing communicates with the interior 106 of the modified casing coupling at one end opening 116 thereof and with an area surrounding the modified casing coupling at an opposite end opening 118 thereof. In the example shown, the through bore 114 communicates with the casing coupling interior by means of a port 120 provided in the sidewall 104 of the modified casing coupling.

The particular pressure relief valve which makes up a part of the APRS device shown in FIGS. 1 and 2 is comprised of a coil spring 122 and sealing ball 124. The through bore 114 of the receptacle housing 102 includes a ball seat 126 adjacent one end opening thereof which receives the sealing ball 124 to establish a fluid tight seal when in the position shown in FIG. 1. The coil spring 122 acts as a tensioning element to urge the sealing ball 124 in the direction of the ball seat 126. An adjustment nut 128 is located below the coil spring 122 for adjusting the amount of tension on the spring and, in turn, on the sealing ball 124. The tension adjustment could also be achieved in other ways, as by installing one or more washers, Belleville springs, or the like, below the coil spring 122.

In use, the sealing ball 124 is exposed to annular pressure trapped between successive lengths of well casing located in the well borehole. The amount of tension exerted on the ball by the tensioning element (coil spring 122) is selected to allow the ball to move off the ball seat and to thereby release trapped annular pressure between the selected casing strings once a predetermined annulus pressure is reached.

As shown in FIG. 2, the through bore 114 can have an oppositely arranged ball seat 130 adjacent the end opening 118, whereby the pressure relief valve can be operated in either of two directions, depending upon which ball seat receives a sealing ball. FIG. 1 shows the pressure relief valve arranged to be acted upon by internal pressure within the casing string. FIG. 2 shows the opposite arrangement where the pressure relief valve is acted upon by external pressure. The reversible nature of the pressure relief valve saves inventory costs and simplifies assembly and repair.

Figure 6:
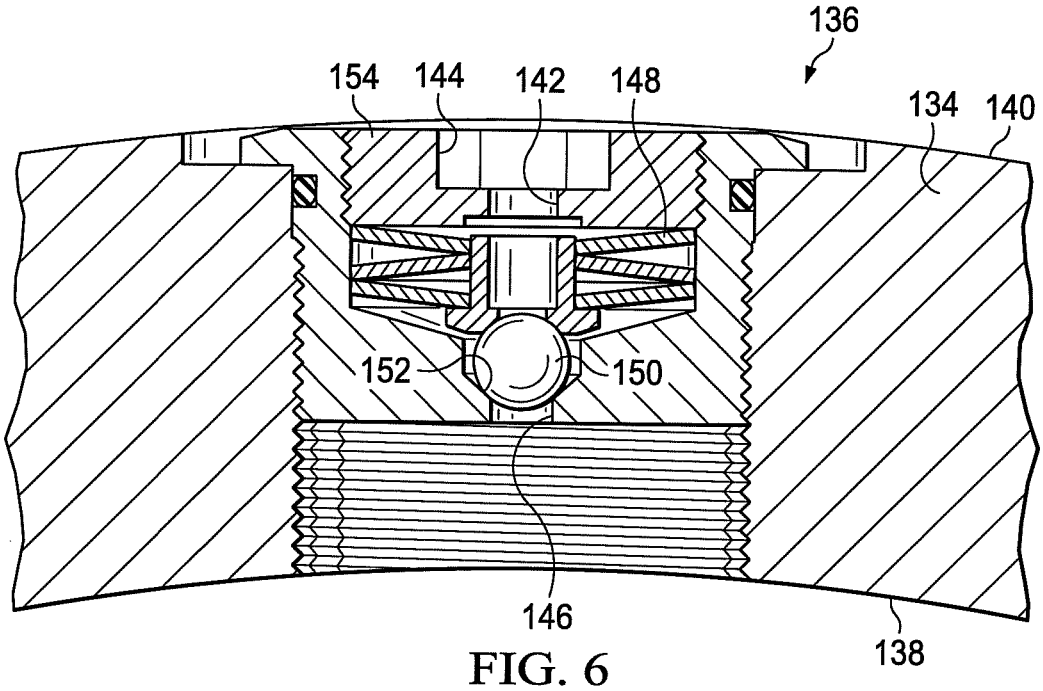
FIG. 6 is a cross sectional view of a preferred pressure relief valve of the invention, the relief valve being incorporated into a modified casing coupling.

FIG. 6 shows a particularly preferred version of the annular pressure relief valve of the invention. In this case, the pressure relief valve (generally designated as 135) is housed in a sidewall 134 of the modified casing coupling 136, so that no protuberance is created in the outer diameter of the casing string. As shown in FIG. 6, the modified casing coupling 136 has interior and exterior sidewalls 138, 140, the interior sidewalls 138 defining the interior of the casing string. The coupling itself would have opposing threaded ends to allow the modified casing coupling to be integrated into the well casing string.

As can be seen in FIG. 6, pressure relief valve again has a through bore 142 with opposing end openings 144, 146. The through bore 146 of the valve communicates with the interior of the modified casing coupling at one end thereof and with an area surrounding the modified casing coupling at an opposite end opening thereof.

Figure 6A:
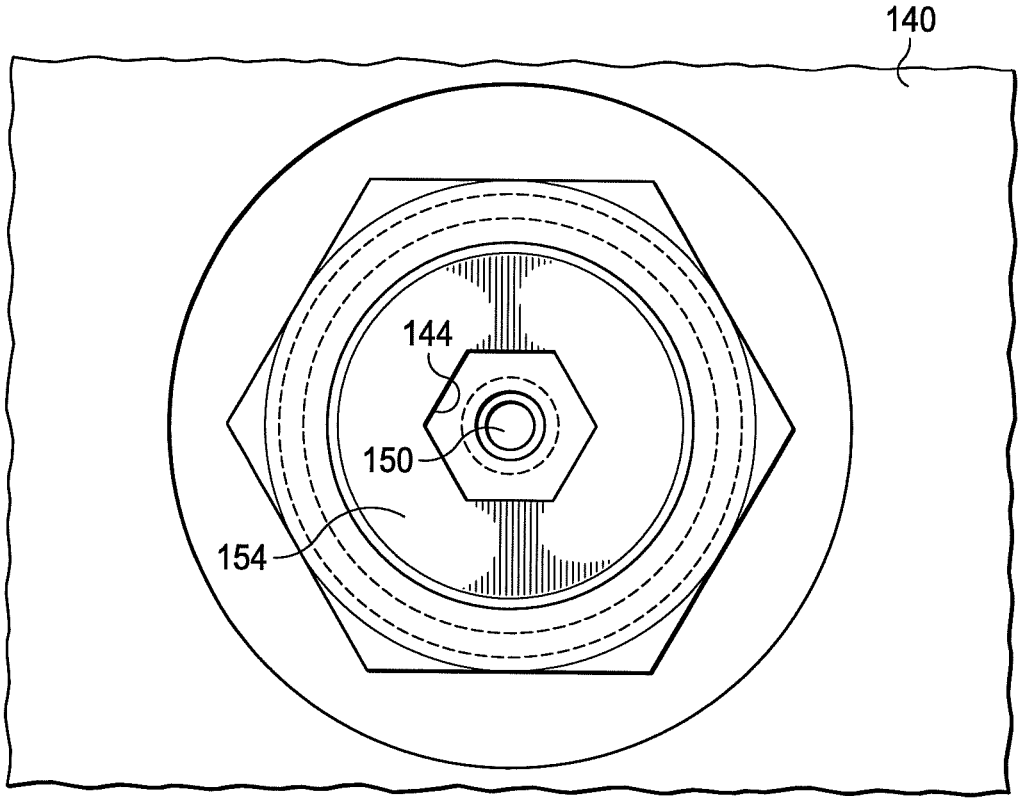
FIG. 6A is a top view of the valve of FIG. 6.
Figure 7:
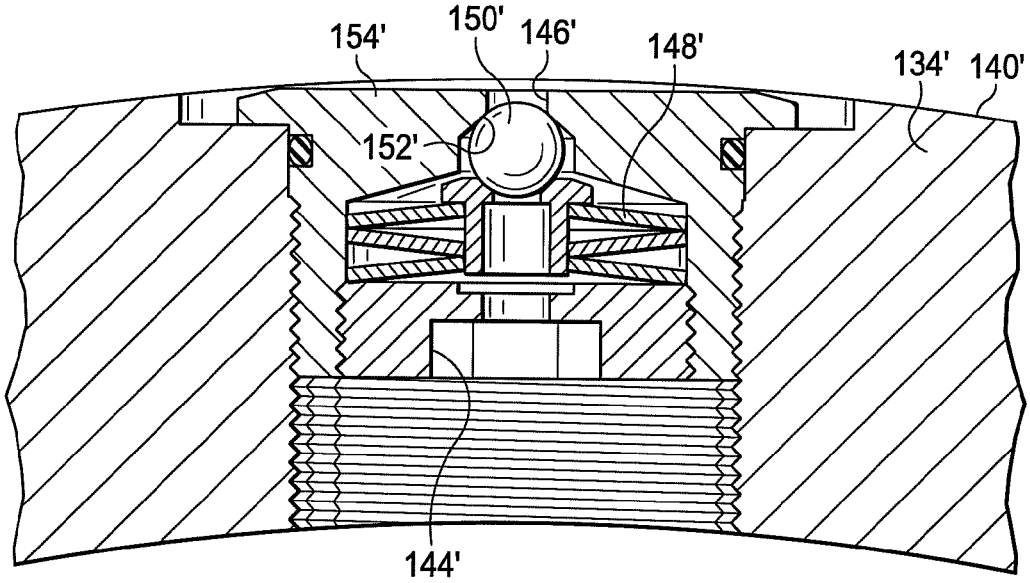
FIG. 7 is a view similar to FIG. 6, but with the ball and ball seat being in reversed positions.

The particular pressure relief valve which makes up a part of the APRS device shown in FIGS. 6 and 7 is comprised of a Belleville spring washer, which exerts tension on a ball 150. The through bore 142 of the valve includes a ball seat 152 adjacent one end opening thereof which receives the sealing ball 150 to establish a fluid tight seal when in the position shown in FIG. 6. A Belleville spring washer 148 is received about a spring carrier 149. The Belleville spring washer 148 acts as a tensioning element to urge the sealing ball 150 in the direction of the ball seat 146. An adjustment nut 154 is provided for adjusting the amount of tension on the spring washer and, in turn, on the sealing ball 150. FIG. 6A is a top view of the pressure relief valve of FIG. 6.

Figure 7A:
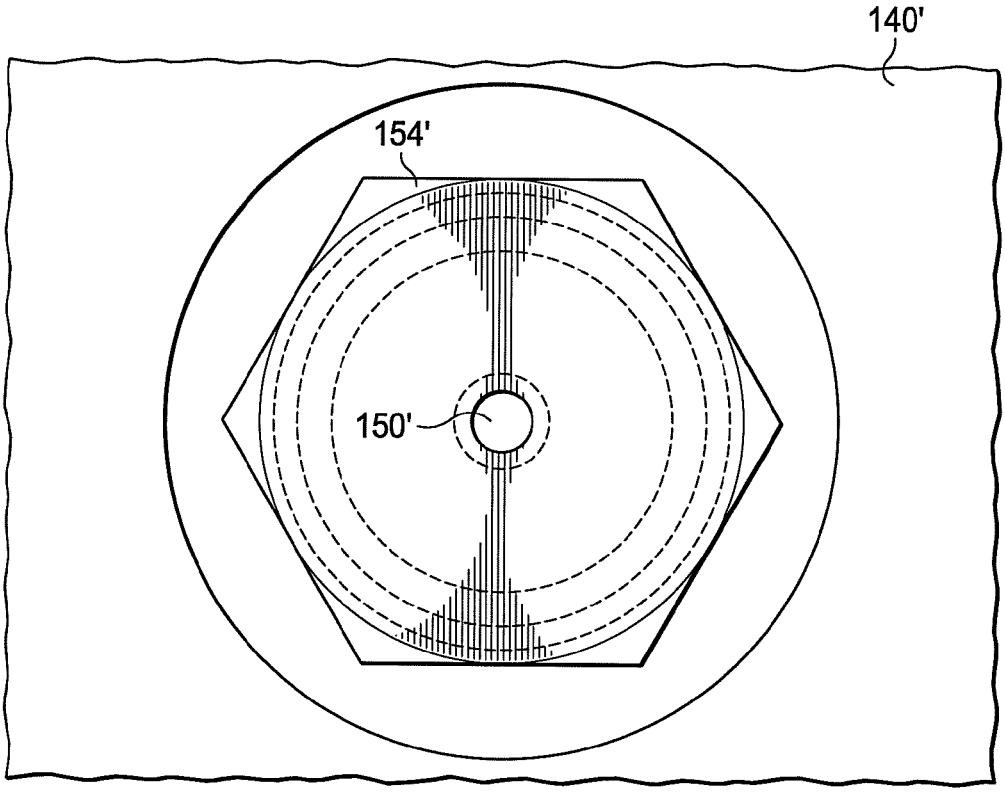
FIG. 7A is a top view of the valve of FIG. 7.

FIG. 7 is a view similar to FIG. 6 except that the ball seat, ball and tensioning spring are oppositely arranged to that pressure external to the casing string acts on the ball to unseat the valve. Thus, FIGS. 6 and 7 correspond to the schematic views presented and described with respect to FIGS. 1 and 2, respectively. The component parts in FIGS. 7 and 7A are numbered with primes to indicate the corresponding parts. FIG. 7A is a top view of the valve of FIG. 7.

Note that the modified casing couplings 136, 136' can accept either of the two respective valve bodies and valve body components by merely threading the respective valve body within the mating threaded opening provided in the modified casing coupling. This feature provides a "bi-directional" option, without requiring providing an inventory of different types of casing couplings.

An invention has been described with several advantages. The pressure relief function of the modified casing coupling will hold a sufficient internal pressure to allow for pressure testing of the casing and will reliably release when the pressure reaches a predetermined level. This predetermined level is less than collapse pressure of the inner string and less than the burst pressure of the outer string. The modified casing coupling of the invention is relatively inexpensive to manufacture and is reliable in operation. The pressure relief valve used in the modified casing coupling can be provided with a ball seat adjacent either end opening thereof, whereby the pressure relief valve can be operated in either of two directions, depending upon which ball seat receives a sealing ball. The pressure at which the sealing ball releases can be compensated for temperature. The modified casing coupling can be removed from the casing string, repaired, and then reinstalled in a casing string. It can conveniently be serviced at the well site and be pressure tuned at the well site.

While the invention is shown in only two of its forms, it is not thus limited but is susceptible to various changes and modifications without departing from the spirit thereof.

What is claimed is:

1. In combination, a subsea well head connected by a subsea conduit to a floating work station, the subsea well head being connected to a plurality of casing strings located in a borehole below the subsea well head and defining at least one casing annulus therebetween, the combination further comprising:

a modified casing coupling for housing a pressure relief valve, the modified casing coupling being located within at least one of the plurality of casing strings located in the borehole below the subsea well head;

the modified casing coupling having sidewalls which define an interior and an exterior of the coupling, and wherein the coupling includes a valve body with a through bore with opposing end openings, the through bore of the valve body communicating with the interior of the modified casing coupling at one end opening thereof and with an area surrounding the modified casing coupling at an opposite end opening thereof, and wherein the valve body adjacent the opposite end opening is flush with the exterior sidewalls of the casing coupling so that no protuberance is created by the presence of the valve body in the casing coupling or with respect to the remainder of the casing string;

wherein the through bore of the valve body includes a ball seat adjacent one end opening thereof which receives a sealing ball, and wherein the ball is urged in the direction of the ball seat by a tensioning element located within the through bore which exerts a given amount of tension on the ball;

wherein the ball is exposed to annular pressure trapped between successive lengths of well casing located in the well borehole and wherein the amount of tension exerted on the ball by the tensioning element is selected to allow the ball to move off the ball seat and to thereby release trapped annular pressure between the selected casing strings once a predetermined annulus pressure is reached; and wherein the modified casing coupling has a threaded opening which can receive two different styles of valve bodies, one which is acted upon by internal casing pressure and one which is acted upon by external casing pressure.

2. The combination of claim 1, wherein the tensioning element is selected from the group consisting of coil springs, washers, Belleville spring washers and combinations thereof.

3. The combination of claim 1, wherein the through bore communicates with the interior of the modified casing coupling by a port provided in a sidewall of the modified casing coupling.

4. The combination of claim 1, wherein the modified casing coupling can be removed from the casing string, repaired, and then reinstalled.

5. The combination of claim 1, wherein the modified casing coupling can be serviced at the well site.

6. The combination of claim 1, wherein the modified casing coupling can be pressure tuned at the well site.

7. A modified casing coupling for use in a subsea well head installation including a plurality of casing strings located in a borehole below the subsea well head and defining at least one casing annulus therebetween, the modified casing coupling comprising:

a modified casing coupling for housing a pressure relief valve, the modified casing coupling being positionable within at least one of the plurality of casing strings located in the borehole below the subsea well head;

the modified casing coupling having sidewalls which define an interior and an exterior of the coupling, and wherein the coupling includes a valve body with a through bore with opposing end openings, the through bore of the valve body communicating with the interior of the modified casing coupling at one end opening thereof and with an area surrounding the modified casing coupling at an opposite end opening thereof, and wherein the valve body adjacent the opposite end opening is flush with the exterior sidewalls of the casing coupling so that no protuberance is created by the presence of the valve body in the casing coupling or with respect to the remainder of the casing string;

wherein the through bore of the valve body includes a ball seat adjacent one end opening thereof which receives a sealing ball, and wherein the ball is urged in the direction of the ball seat by a tensioning element located within the through bore which exerts a given amount of tension on the ball;

wherein the ball is exposed to annular pressure trapped between successive lengths of well casing located in the well borehole and wherein an adjustment nut is threadedly received within the valve body in contact with the tensioning element, the adjustment nut being threadedly adjustable from the exterior of the modified casing coupling, whereby the amount of tension exerted on the ball by the tensioning element can be selected at the well site to allow the ball to move off the ball seat and to thereby release trapped annular pressure between the selected casing strings once a predetermined annulus pressure is reached; and wherein the modified casing coupling has a threaded opening which can receive two different styles of valve bodies, one which is acted upon by internal casing pressure and one which is acted upon by external casing pressure.

* * * * *